US005086573A

United States Patent [19]

Mabboux et al.

[11] Patent Number: 5,086,573

[45] Date of Patent: Feb. 11, 1992

[54] WEARING APPAREL HAVING AN ENERGY CONSUMING DEVICE

[75] Inventors: Michel Mabboux, Seynod; Jean-Louis DeMarchi, Duingt, both of France

[73] Assignee: Salomon S.A., Annecy Cedex, France

[21] Appl. No.: 432,893

[22] Filed: Nov. 7, 1989

Related U.S. Application Data

[63] Continuation-in-part of Ser. No. 409,457, Sep. 19, 1989.

[30] Foreign Application Priority Data

Sep. 19, 1988 [FR] France ..... 88 12197
Nov. 8, 1988 [FR] France ..... 88 14549

[51] Int. Cl.[5] ..... A43B 7/02; A43B 5/04

[52] U.S. Cl. ..... 362/2.6; 36/50; 36/117

[58] Field of Search ..... 36/2.6, 50, 117, 137, 36/139; 200/61.58 R, 61.59; 219/201, 209, 211, 215

[56] References Cited

U.S. PATENT DOCUMENTS

| | | | |
|---|---|---|---|
| 3,663,796 | 5/1972 | Hines et al. | 36/2.6 |
| 3,974,491 | 8/1976 | Sipe | 36/137 X |
| 3,977,093 | 8/1976 | Santroch | 36/2.6 |
| 4,180,922 | 1/1980 | Cieslak et al. | 36/2.6 |
| 4,646,350 | 2/1987 | Batra | 36/50 X |
| 4,736,530 | 4/1988 | Lakic et al. | 36/2.6 |
| 4,771,556 | 9/1988 | Kim | 36/139 |
| 4,780,968 | 11/1988 | Bragagnold | 36/2.6 |

FOREIGN PATENT DOCUMENTS

| | | | |
|---|---|---|---|
| 0146792 | 7/1985 | European Pat. Off. | 36/2.6 |
| 2080146 | 10/1971 | France . | |
| 1136269 | 1/1980 | Italy . | |
| 196850 | 2/1984 | Italy . | |
| 8605663 | 10/1986 | PCT Int'l Appl. | 36/2.6 |
| 1223883 | 11/1986 | U.S.S.R. | 36/2.6 |

*Primary Examiner*—Paul T. Sewell
*Assistant Examiner*—BethAnne C. Cicconi
*Attorney, Agent, or Firm*—Sandler, Greenblum & Bernstein

[57] ABSTRACT

An item of wearing apparel for receiving an extremity, such as a ski shoe or boot for receiving a foot, provided with an energy source supplying an energy consuming device, such as a heating device, and a device controlling a supply element of the energy consuming device connected between the energy source and the consumer device. The shoe or boot includes a device for detecting the presence of a foot within the boot so as to allow the opening of the energy supplying element alone when the boot is put on and to automatically cause the closing of this supply element as soon as the boot is removed. The energy consuming device incorporated in the boot can be a heating device of the electric type in which case the device for detecting the presence of the foot in the boot acts on an electric switch connected, between an electric energy source and a heating assembly with heat resistance, or even the type using liquid or gaseous fuel and in this case, the device for detecting the presence of the foot in the boot acting on a device controlling a valve connected between a gas or liquid fuel tank and a heating assembly. Preferably, the device for detecting the presence of the foot in the boot are sensitive to the pressure exerted by the foot on the internal sole of the boot and this detection of the pressure is transmitted mechanically to the device controlling the element for supplying the heating assembly with energy. The boot with an upper according to the invention which can be an alpine or cross-country ski shoe or boot is provided with a heating device which, in the case of the non-limiting embodiment presently described, is of the gas fuel type. However, the invention could be applied in the same manner to a boot provided with an electric or liquid fuel heating device.

31 Claims, 3 Drawing Sheets

WEARING APPAREL HAVING AN ENERGY CONSUMING DEVICE

This application is a continuation-in-part of application Ser. No. 07/409,457, filed on Sept. 19, 1989, the subject matter of which is hereby incorporated by reference.

BACKGROUND OF THE INVENTION

1. Field of the Invention

The present invention relates to a downhill or cross-country ski shoe or boot having a shell base on which at least one upper element is journalled for movement, such a rear or front spoiler, for permitting the skier to put on and take off the shoe or boot, wherein the shoe or boot includes an energy source, an energy consuming device, such as a heating device, and an apparatus for controlling the energy supply for the energy consuming device.

2. Description of Background Information

Ski shoes or boots are known which are intended to improve the comfort of the wearer by means of the incorporation of heating devices. These devices include the electric type, which use a heating resistance, and the liquid or gaseous fuel type, which use a reservoir of fuel and a burner positioned in the shoe or boot. The heating devices having liquid or gaseous fuel are advantageous, compared to electric devices, in making it possible to obtain a greater autonomy, making them more convenient, and to ensure, during a relatively long period of time, a desired level of comfort of the shoe or boot with regard to the temperature.

Heating devices using a liquid fuel, such as those described, for example, in Italian patent No. 1,136,269 and French Patent No. 2,080,146, generally comprise a burner having rechargeable liquid fuel, which is positioned under a heat diffusion plate incorporated into the sole of the shoe or boot so as to extend as close as possible to the foot of the wearer of the shoe or boot. Other heating devices which use a gaseous fuel comprise a reservoir of gas which feed, through a valve, a catalytic burner, all of these elements being likewise totally positioned within the sole of the shoe or boot.

Such heating devices having gaseous fuel are described, for example, in Italian Design No. 196,850 and in International Patent Application WO 86/05663. Heating devices using gaseous fuel are of the type having a rechargeable gas reservoir and it is consequently necessary to provide, in the sole of the shoe or boot which contains the reservoir, an orifice through which the internal gas reservoir can be connected to an external recharging source of external gas.

All the known heating devices, either of the electric type or of the type using liquid or gaseous fuel, have the disadvantage that once heating is started, stopping the heating can only be obtained through manual intervention by the wearer of the boot. Otherwise stated, the wearer of the boot must think of cutting off the heating when he takes off his boot and, consequently, it is obviously possible for him or her to forget to perform this operation, which then translates into a continuation of the heating of the removed boot, thus a rapid exhaustion of the energy source used and a waste of this energy.

SUMMARY OF THE INVENTION

It is an object of the present invention to improve upon known apparatus. To this end, the present invention is directed to an item of wearing apparel which includes a portion for receiving an extremity, the item of wearing apparel further including:

(a) an energy source;

(b) an energy consuming device; and (c) means for controlling the supply of energy from the energy source to the energy consuming device including means for preventing the supply of energy from the energy source to the energy consuming device in response to removal of the extremity from the means for receiving an extremity.

According to a specific aspect of the invention, the energy consuming device includes a heating device of either an electric or gaseous type. Specifically, the heating device could be an interchangeable gas fuel cartridge.

According to a further specific aspect of the invention, the item of wearing apparel is a boot, such as an alpine or cross-country ski shoe or boot.

More specifically, the boot includes an upper and the energy source and the means for controlling the supply of energy from the energy source to the energy consuming device is supported by the upper.

Still further according to the invention, the energy consuming device is a heating apparatus.

In a still further aspect of the invention, the means for preventing the supply of energy from the energy source to the energy consuming device includes means for detecting the presence of an extremity, such as a foot within a boot, and the supply of energy is prevented upon the failure of the detecting means to detect the presence of a foot.

In a still further specific aspect of the invention, the means for controlling the supply of energy from the energy source to the energy consuming device includes a manually actuated energy supply switch movable at least between an ON position, in which the supply of energy is permitted between the energy source and the energy consuming device, and an OFF position, in which the supply of energy is prevented from the energy source, wherein the means for controlling the supply of energy from the energy source to the energy consuming device includes means for linking the means for detecting the presence of an extremity within the means for receiving an extremity to the energy switch, wherein upon the failure of the detecting means to detect the presence of an extremity, the energy switch is permitted to move to the OFF position.

Further according to the invention, the item of wearing apparel includes means for biasing the energy switch toward the OFF position and means for maintaining the energy switch in the ON position against the force of the means for biasing in response to the detecting means detecting the presence of an extremity.

As applied to a boot, the means for detecting the presence of a foot therein includes a member located proximate an internal sole of the boot which is moved by means of pressure exerted thereon by the foot.

It is an additional object of the invention to provide an alpine or cross-country ski boot having an energy source for supplying an energy consuming device and a device for controlling an element for supplying the energy consuming device connected between the energy source and the consuming device, wherein the boot includes means for detecting the presence of a foot within the boot for allowing the opening of the element for supplying energy only when the foot is inserted into the shoe or boot and for automatically closing the supply element in response to the removal of the foot from the boot.

According to a specific embodiment of the invention, the energy consuming device incorporated in the boot is a heating device of the electric type, wherein the supply element includes an electric switch connected between an electric energy source and at least one heat-resistant element, wherein the means for detecting the presence of the foot in the boot acts on the electric switch for producing heat by means of the at least one heat-resistant element.

According to an additional embodiment of the invention, the energy consuming device incorporated in the boot is a heating device of the liquid or gaseous fuel type, wherein the boot further includes a reservoir for containing the fuel, wherein the supply element includes a valve for controlling the supply of the fuel from the reservoir to the heating device, and wherein the device for controlling the element includes a device for controlling the opening and closing of the valve, wherein the means for detecting the presence of the foot in the boot acts on the device for controlling the valve.

It is a specific aspect of the invention applied to the latter mentioned embodiment to provide a boot in which the means for detecting the presence of the foot in the boot is sensitive to the pressure exerted by the foot on an internal sole of the boot, wherein the detection of the pressure is 10 transmitted mechanically to the device for controlling the opening and closing of the valve.

Still further according to the invention, the boot includes an upper and a control knob mounted for generally vertically movement outside the rear wall of the upper, wherein the device for controlling the opening and closing of the valve includes a device for activation of the valve for supplying the heating device with energy, the activation element, mounted for generally vertical movement within the upper of the boot, being moved by the control knob, the movable activation device supporting a latching means cooperating with an immobilization means supported by the upper and on which act the means for detecting the pressure of the foot so as to lock and unlock into a latching position the immobilization means, as a function of whether pressure is exerted on the internal sole of the boot, and, consequently, to latch and unlatch the activation element for opening and closing the valve, respectively.

Still further, the energy supply control device includes two substantially vertical plates, adjacent to one another, generally contained in vertical and longitudinal planes, including a manual control plate and an activation plate, wherein the activation device includes the activation plate for the supply valve, the activation plate having a greater height than the manual control plate, extending both above and beneath the manual control plate, wherein the activation plate supports, on its lower part, a lug for activating a control pin of the valve, the manual control plate having substantially the shape of a C open towards the rear and including a generally vertical member extended, at its two ends, by a lower wing and an upper wing, respectively, the upper wing of the manual control plate extending outside the rear wall of the upper, and supporting, at its external end, the control knob, the activation plate being biased constantly upwardly by a spring which is coupled to the manual control plate by means permitting a relative vertical movement of the manual control plate with respect to the activation plate.

In a still further aspect of the invention, the manual control plate includes, on an upper part, a lug extending upwardly and acting on a pawl which is journalled on the upper part of the activation plate about a generally horizontal and transverse axis, the pawl being in the form of a lever having two arms forming an acute angle and extending toward a rear wall of the upper, an end of the the lower arm of the pawl being in contact with the lug and the upper arm of the pawl extending upwardly as far as the rear wall of the upper, the pawl being biased by a spring such that the upper arm is pushed constantly in the direction of the rear wall of the upper on which a slide is mounted for vertical movement, the slide forming a movable abutment for the pawl, the slide being connected, by a rod assembly, to a lever lodged in the sole of the boot and activated by the internal sole.

Still further, the lever is journalled, at a front end, about a generally horizontal and transverse axis, the lever being biased upwardly by a spring, the lever being hooked, at a rear end, to the linkage rod assembly and on the lever rests a rear end portion of the internal sole.

In a still further aspect of the invention, the movable slide forms an abutment for the pawl having the shape of an inverted U, the slide including an upper horizontal and transverse member which is extended downwardly by two lateral and vertical wings connected to the linkage rod assembly, the upper member having a lower edge constituting a movable abutment for the end of the upper arm of the pawl.

Still further, the lower edge of the upper member of the slide is provided, in a central part thereof, with a cutout open downwardly and in which can engage a tooth solidly affixed with an internal surface of the rear wall of the upper, the tooth having substantially the shape of a right triangle whose upper side, constituting one of the sides of the triangle, serves as an abutment for the slide during downward movement of the slide and whose hypotenuse extends downwardly and forms a disengagement ramp for the pawl.

According to a specific aspect of the invention, the boot includes a shell base on which is journalled a rear spoiler, about a generally horizontal and transverse axis, wherein the activation plate supports, at a lower part, a hook for engagement with an extreme upper part of a latching spring supported by a lower part of the rear spoiler.

In an additional aspect of the invention, the latching spring includes a central upper part in the shape of a loop, open downwardly, having two lateral arms extending, at lower ends thereof, by helical coaxial windings surrounding a generally horizontal and transverse axis supported by the lower and rear part of the rear spoiler, the helical coaxial windings having extending generally coplanar support arms forming an acute angle with the upper loop and applied against the upper part of a lever substantially in the shape of an L which includes a lower wing substantially horizontal, extending frontwardly, under a rear part of the internal sole, a return spring being lodged beneath the lower horizontal wing of the lever to continuously push the wing upwardly, and an external projection, forming a disengagement ramp for the spring, which is provided on the lower part of a rear wall of the shell base to act on the support arms of the spring, at the end of the opening movement of the rear spoiler, and to enable the spring to escape from the hook of the activation plate.

Still further, each of the support arms of the spring has substantially the shape of a U open downwardly, whose arms extend both above and beneath the winding axis.

According to a still further aspect of the invention, the upper part of the lever has slots which are inclined from top to bottom and from front to rear, within which horizontal and transverse projections extend which are solidly affixed with the shell base, to control movement of the lever.

Still further, the lever is journalled about a generally horizontal and transverse axis provided at the front end of the lower arm of the lever, the lever pivotal in one direction or another about the lever axis, either under the action of the internal sole or under the action of the return spring.

BRIEF DESCRIPTION OF THE DRAWINGS

Preferred embodiments of the present invention are described below, by way of non-limiting examples, in which further objects, features, and advantages of the present invention will become apparent, with reference to the annexed drawings in which.

DETAILED DESCRIPTION OF THE PREFERRED EMBODIMENTS

Figure 1:
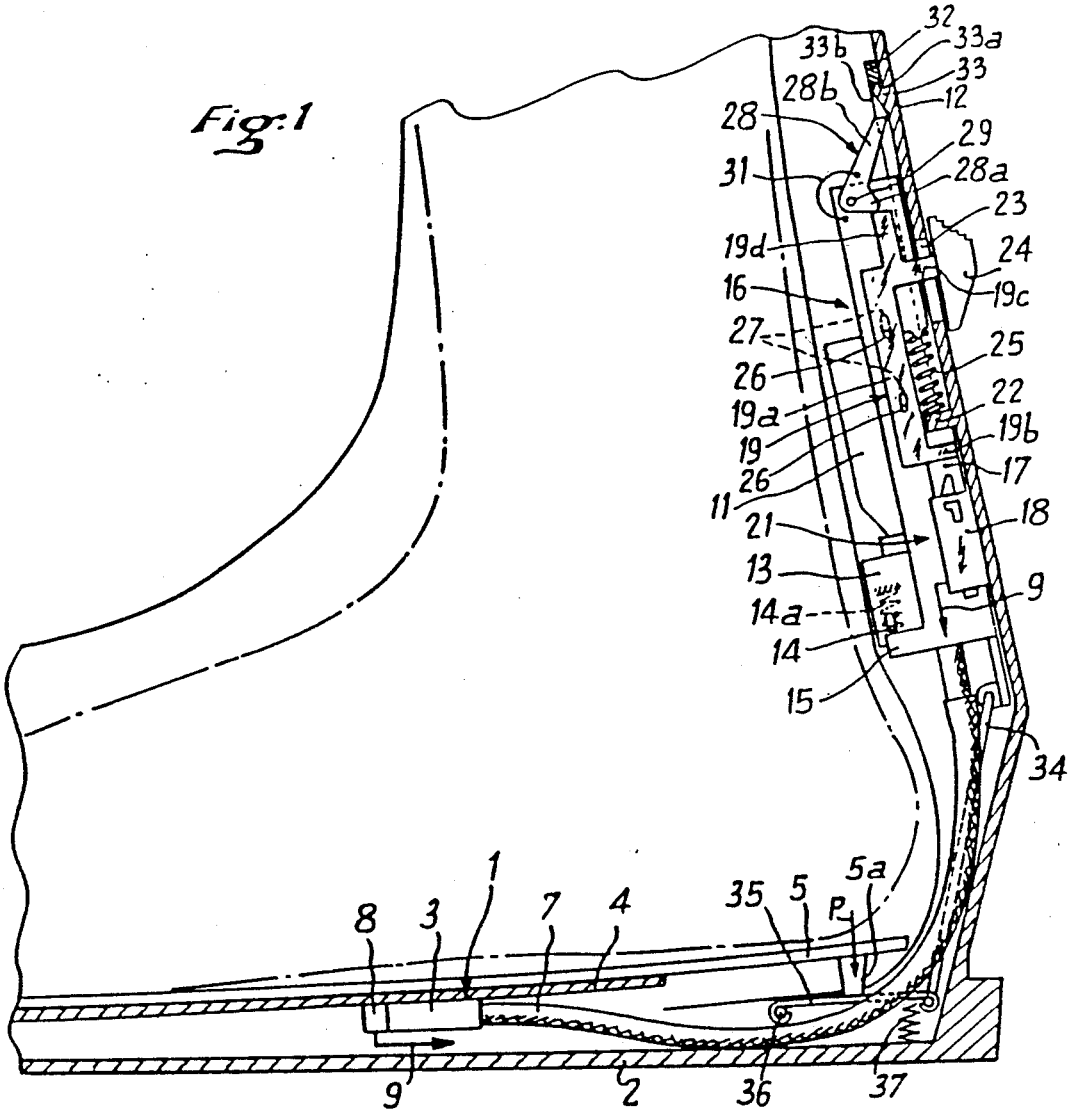
FIG. 1 is a vertical and longitudinal sectional view of a boot with an upper in a single portion provided with a gas heating device according to the invention.

As mentioned above, an object of the present invention is to overcome the disadvantages of the above-mentioned known devices by providing a boot having means for automatically causing the cutting off of the energy supply as soon as the wearer of the boot removes the boot.

To that end, the downhill or cross-country ski shoe or boot, equipped with an energy source supplying an energy consuming device, such as a heating device, and a device controlling a supply element of the energy consuming device connected between the energy source and the consumer device. The shoe or boot includes means detecting the presence of a foot within the boot so as to allow the opening of the energy supplying element alone when the boot is put on and to automatically cause the closing of this supply element as soon as the boot is removed.

The energy consuming device incorporated in the boot can be a heating device of the electric type, in which case the means which detects the presence of the foot in the boot acts on an electric switch connected between an electric energy source and a heating assembly with heat resistance, or even the type using liquid or gaseous fuel, in which case the means detecting the presence of the foot in the boot acts on a device controlling a valve connected between a gas or liquid fuel tank and a heating assembly.

Preferably, the means detecting the presence of the foot in the boot are sensitive to the pressure exerted by the foot on the internal sole of the boot and this detection of the pressure is transmitted mechanically to the device controlling the element for supplying the heating assembly with energy.

The boot having an upper according to the invention, which can be an alpine or cross-country ski shoe or boot, is provided with a heating device which, in the case of the non-limiting embodiment presently described, is of the gas fuel type. However, the invention could be applied in the same manner to a boot provided with an electric or liquid fuel heating device.

With regard to the invention as illustrated in the drawings, the heating device includes a heating assembly 1 which is positioned in an opening with an appropriate shape provided in the upper part of sole 2 of the boot. This heating assembly 1 includes a burner 3 affixed for example, by welding, under a heat diffusion plate 4 itself placed under the internal sole 5 of the boot so as to be able to heat the skier's foot in extremely cold weather. The burner 3 is connected to a gas supply tube 7 and an electrode 8 is located near the burner 3, the electrode being part of an ignition device of the piezoelectric type, for example, to which it is connected by a conductor 9.

The heating assembly 1 is supplied with gas from an interchangeable gas fuel cartridge 11 which is held in a housing provided in the rear part of the upper 12 of the boot, within the latter. The gas cartridge 11 is positioned substantially vertically with its orifice for gas output directed downwardly. In the description which follows, the direction "vertical" will be considered the direction in which the upper 12 extends, whereas in fact the rear wall of the upper is slightly inclined frontwardly. The gas cartridge 11 is connected, at its lower end, to a supply element 13 constituted by an assembly forming a pressure reducing valve having an element for control of the opening and closing of the valve constituted by a pin 14 projecting outside the body of valve 13 and movable in a generally vertical slot of the body. The pin 14 is pushed downwardly, in the direction of its open position, by a return spring **14*a* lodged within the pressure-reducing valve 13. The pin 14 for control of valve 13 is activated by a lug 15 which is part of a gas supply control device 16. This device 16 acts likewise on a pusher 17 of an ignitor 18, for example, of the piezoelectric type, which is connected by the electric conductor 9 to the electrode 8** so as to produce an ignition spark.

In the non-limiting embodiment shown in FIG. 1, the gas supply control device 16 which acts on the valve 13, includes two substantially vertical plates, adjacent to one another, contained in the vertical and longitudinal planes, namely, a manual control plate 19 of relatively short height, and a plate 21 for activation of the valve 13, of greater height, extending both above and beneath the plate 19. The plate 21 for activation of valve 13, with a generally rectangular shape, supports at its lower part the lug 15 extending under the pin 14 and in contact therewith. The manual control plate 19 substantially has the shape of a C open towards the rear and it includes a vertical member 19*a* extended at its two ends, by a lower wing 19*b* and an upper wing 19*c*, respectively. The lower wing 19*b* serves to activate the pusher 17 of the piezoelectric ignitor 18 and it is lodged between the upper surface of the pusher 17 and an internal projection 22 of the rear wall of the boot upper. The upper wing 19*c* of the manual control plate 19 extends outside the rear wall of upper 12, while passing through a generally vertically elongated slot 23. At the external end of this wing 19*c* is affixed a control knob 24. Moreover, the plate 21 is constantly biased upwardly by a compression spring 25 resting on the upper surface of the internal projection 22.

The two plates 19 and 21 are coupled to one another by means which permit a relative vertical movement of the manual control plate 19 with respect to the activation plate 21. More particularly, the member 19*a* of the manual control plate 19 supports two guide pins 26, generally aligned vertically and which are engaged in respective slots 27 which are provided in the activation plate 21 for valve 13 and which are generally vertically aligned.

The manual control plate 19 likewise includes, at its upper part, a lug 19*d* extending upwardly and acting on a pawl 28 which is journalled on the upper part of the valve activation plate 21, about a horizontal and transverse axis 29. The pawl 28 is embodied in the form of a lever with two arms forming an acute angle and extending in the direction of the rear wall of upper 12. The lower arm 28*a* of pawl 28 is in contact, at its end, with the upper end of the activation lug 19*d* and the upper arm 28*b* of the pawl extends upwardly as far as the rear wall of upper 12. The pawl 28 is biased in a clockwise direction by a spring 31, so that its upper arm 28*b* is constantly pushed in the direction of the rear wall of upper 12.

Figure 5:
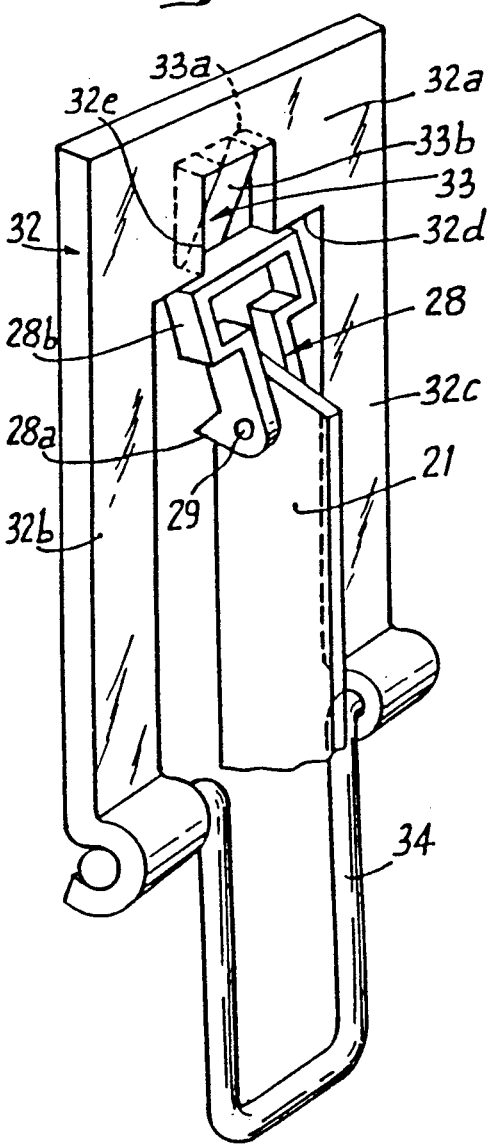
FIG. 5 is an enlarged view in simplified perspective, of the gas supply control device.

The gas supply control device 16 includes, moreover, a slide 32, as shown in FIG. 5, having the shape of an inverted U, which is mounted for generally vertical movement along the internal surface of the rear wall of upper 12. The slide 32 includes an upper horizontal and transverse member 32*a* which is extended downwardly by two lateral wings 32*b* and 32*c*. The lower edge 32*d* of member 32*a* constitutes a movable abutment for the upper end of the upper arm 28*b* of pawl 28. This lower edge 32*d* is cut, in its central portion, into a cutout 32*e* open downwardly and in Which can engage a tooth 33 which is solidary with the internal surface of the rear wall of upper 12. This tooth 33 has substantially the shape of a right triangle, whose upper side 33*a*, constituting one of the sides of the right angle, serves as an abutment for the slide 32 in its downward movement. The hypotenuse 33*b* of the triangular tooth extends downwardly and it forms a disengagement ramp for pawl 28.

Figure 9:
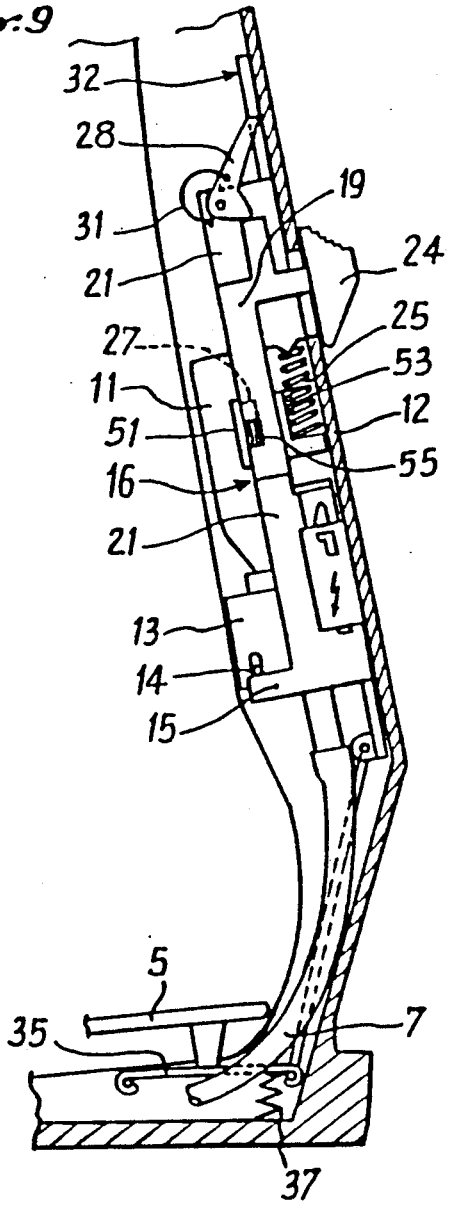
FIG. 9 is a vertical and longitudinal sectional view of an alternative embodiment of the gas supply control device.

At their lower ends, the two vertical wings 32*b*, 32*c* of slide 32 are connected, by means of a rod assembly 34, to a substantially horizontal lever 35 lodged in the sole 2 of the boot, as shown in FIG. 9. This lever 35 is journalled, at its front end, about a horizontal and transverse axis 36 and it is biased upwardly by a spring 37. This lever 35 is hooked at its rear end, to the linkage rod assembly 34. On this lever 35 rests, by means of a plug 5*a*, the extreme rear part of the internal sole 5.

Figure 2:
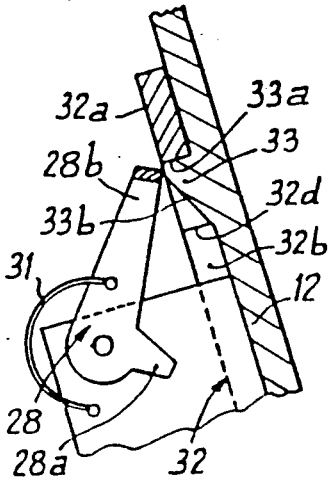
FIGS. 2, 3, and 4 are partial vertical and longitudinal sectional views on an enlarged scale illustrating the functioning of the gas supply control device.

When the skier's foot is engaged in the boot, as is shown schematically in dotted lines in FIG. 1, a pressure, illustrated by arrow P, is exerted on the internal sole 5 of this boot and the extreme rear end thereof is pushed downwardly, as is lever 35. The downward pivoting of lever 35 is transmitted to slide 32, by means of rod assembly 34, and this slide 32 then occupies its extreme lower position, as shown in FIG. 2, in which its horizontal member 32*a* abuts against the upper side 33*a* of the tooth 33, which is then engaged in the bottom of cutout 32*e*. The pawl then freely rests, by the upper end of its upper arm 28*b*, on the internal vertical surface of member 32*a* as is shown in FIG. 2. In this position, gas supply control device 16 is normally in the closed position. The plate 21 for activation of valve 13 is in effect pushed by spring 25, into the extreme upper position and its lower lug 15 holds pin 14 for activation of valve 13, in its extreme upper position corresponding to the closure of the valve. Moreover, the manual control plate 19 is likewise pushed into its extreme upper position by means of plate 21, the position in which its lower wing 19*b* is in contact with projection 22.

Figure 3:
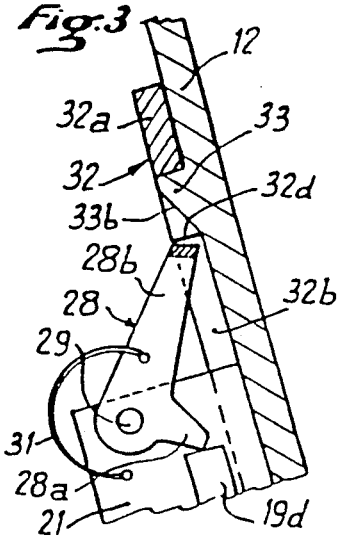

If the skier wishes to start up the heating device, he or she presses down on the control knob 24, which has the effect of causing the descent of the two plates 19 and 21, against the action of the return spring 25. The descent of lug 15 frees pin 14 which is then pushed into the lower open position by spring 14*a* so that valve 13 opens and permits the gas to flow in the direction of burner 3. By temporarily continuing the descending movement of the control knob 24 beyond the intermediate open position, plate 19 pushes, by means of its lower wing 19*b*, the pusher 17 of piezoelectric ignitor 18, which then causes the production of a spark in electrode 8 to ignite the gas. After release of the control knob 24, the latter is automatically put under the action of return spring 25, in the intermediate open position which is shown in FIG. 1. It is retained in this position because the pawl 28 is then latched, as is shown in FIG. 3. In fact, in the course of the descending movement of plate 21 for activation of valve 13, the upper arm 28*b* of pawl 28 slides on the internal surface of upper member 32*a* of slide 32 and when it arrives just underneath the lower edge 32*d* of this member 32*a*, the pawl 28 pivots in a clockwise direction, about its axis 29, under the action of spring 31, the end of the upper arm 28*b* of pawl 28 engages under the lower edge 32*d* of member 32*a* and it is thus immobilized by the latter. The pawl 28 being thus latched, its lower arm 28*a* constitutes a fixed abutment against which is applied the upper lug 19*d* of plate 19, while thus preventing the automatic return of the two plates 19 and 21 in the closed position. However, the skier can cut off the heating at any time, by pulling the control knob 24 upwardly. In this case the lug 19*d* applies a force against the pawl 28 and makes it pivot in a counterclockwise direction about axis 29 while thus disengaging the upper arm 28*b* from edge 32*d*. From this moment the two plates 19, 21 can slide automatically upwardly, under the action of return spring 25, to pass into the closed position of the gas supply.

Figure 4:
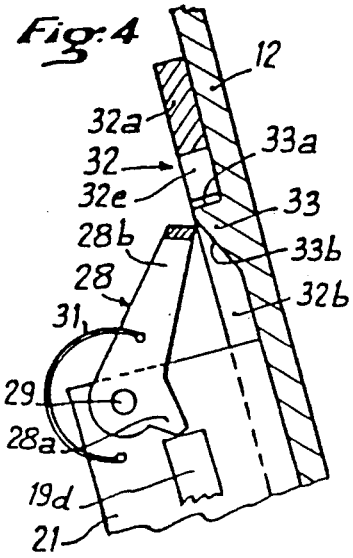

According to the preceding description, it can be seen that, for pawl 28 to be latched in position and constitute an abutment to hold plates 19 and 21 in the open gas supply position, it is necessary that the slide 32 be in the lower position or, otherwise stated, a pressure is exerted on the rear part of the internal sole 5. Consequently, if the skier forgets to cut off the heating when his or her boot is removed, the cutting off of the gas supply to the burner 3 is carried out automatically as soon as the boot is removed, because the internal sole 5 is then no longer subject to pressure. In fact, in this case, lever 35 pivots upwardly under the action of spring 37, the sliae 32 is displaced upwardly, in the rest or closed position illustrated in FIG. 4, and the two plates 19, 21 likewise move upwardly into the extreme upper closed position because pawl 28 is no longer latched. During this movement, the end of upper arm 28*b* of pawl 28 slides on the ramp 33*b* of tooth 33, which causes a pivoting of pawl 28 in a counterclockwise direction about axis 29, against the action of spring 31.

Figure 6:
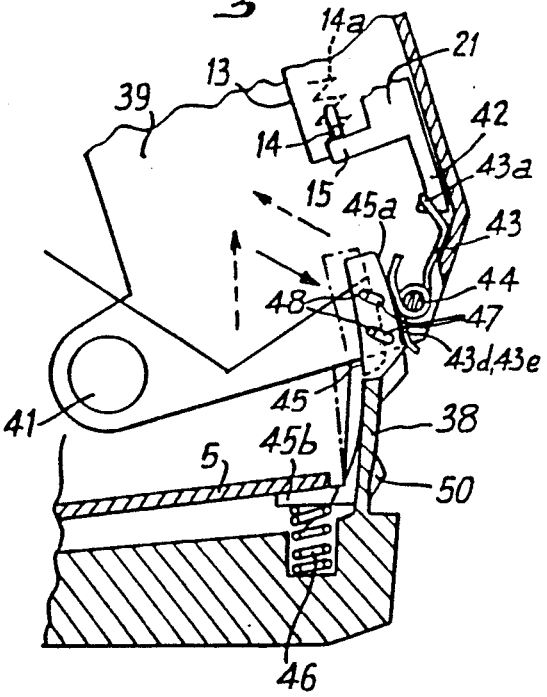
FIG. 6 is a vertical and longitudinal sectional view of the lower and rear part of a downhill ski boot with a journalled rear spoiler.
Figure 7:
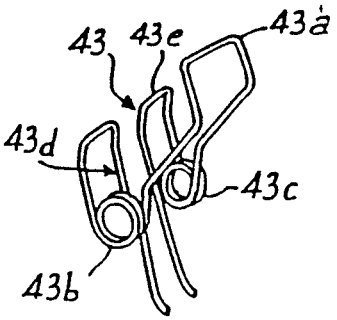
FIG. 7 is a perspective view of the latching spring used in the heating device incorporated in the boot of FIG. 6.

FIG. 6 illustrates an alternative embodiment of the invention applied to an alpine ski boot of the type comprising a shell base 38 on which is journalled a rear spoiler 39, about a horizontal and transverse axis 41. In this case, the latching of plate 21 for activation of valve 13, in the open position, is ensured by a hook 42 extending this plate downwardly and which engages with the extreme upper part of a latching spring 43 supported by the lower part of rear spoiler 39. This spring 43, shown in a detailed manner in FIG. 7, includes a central upper part 43*a* in the shape of a loop, open downwardly, which is generally planar or which preferably forms a dihedral with an obtuse angle open towards the interior, as is shown in the drawing, so as to best follow the shape of rear spoiler 39. The two lateral arms of loop 43*a* are extended, at their lower ends, by helical coaxial windings 43*b* and 43*c* surrounding a horizontal and transverse axis 44 supported by the lower and rear part of rear spoiler 39. The helical coaxial windings 43*b*, 43*c* are in turn extended by coplanar support arms 43*d*, 43*e*, forming an acute angle with the upper loop 43*a*. Preferably, each of the support arms 43*d*, 43*e* has substantially the shape of a U open downwardly, whose external arm extends both above and underneath the winding axis 44. The coplanar support arms 43*d*, 43*e* are adapted to be applied against the upper part 45*a*, downwardly retractable, of a lever 45 substantially having the shape of an L which includes a substantially horizontal lower wing 45*b* extending frontwardly, under the extreme rear part of the internal sole 5. A return spring 46 is lodged underneath the lower horizontal wing 45*b* and this spring permanently pushes this wing upwardly. Moreover, in the upper part 45*a* of lever 45 are provided slots 47 which are inclined from top to bottom and from front to rear and in these slots extend horizontal and transverse projections 48 solidary with shell base 38 to control the movement of lever 45.

In FIG. 6, lever 45 is shown in solid lines in the position that it occupies when the shoe or boot is put on, and in dotted lines in the opposite case. Consequently, when the shoe or boot is put on, the internal sole 5, which is subjected to the pressure of the foot, rests, by its extreme rear part, on the lower horizontal wing 45*b* of lever 45, which has the effect of making this lever 45 descend, in its entirety, from its position indicated in dotted lines to its position indicated in solid lines. Because of the linkage between the shell base 38 and the lever 45 achieved by the slots sliding on projections 48, these slots cause, due to their inclination, a displacement of the upper part of lever 45 towards the exterior of the boot. In the position reached, the rear surface of the upper part 45*a* of lever 45 constitutes a support surface against which are pressed the coplanar arms 43*d*, 43*e* of spring 43. The spring 43 is thus held in a latching position in which it can ensure the retention of hook 42, when the plate 21 is in the low open position, and, consequently, the maintaining of the gas supply control valve in the open position. During the removal of the boot, spring 46 pushes the lower wing 45*b* and the assembly of lever 45 upwardly, which has the effect of making lever 45 pass into its rest position indicated in dotted lines. Because of slots 47 and projections 48, the rear support surface of the upper part 45*a* of lever 45 separates the support arms 43*b*, 43*c* from the remainder of the spring 43. Moreover, because of the rocking movement of the complete opening of the rear spoiler 39, before the skier disengages his or her foot from the shoe or boot, the arms 43*d*, 43*e* of spring 43 come into contact with an external projection 50 provided on the lower part of the rear wall of shell base 38. This projection 50 constitutes a disengagement ramp causing, when the arms 43*d*, 43*e* of spring 43 come into contact with it, by their extreme lower parts, a pivoting, in a counterclockwise direction, of the spring assembly 43 about axis 44 so that loop 43*a* of spring 43 is disconnected from its linkage with hook 42. As a result, hook 42 is no longer retained, it then automatically escaping from spring 43, and the gas supply control valve returns automatically to the closed position.

The automatic cutting off of the gas supply is likewise obtained during the rocking of the rear spoiler 39 towards the rear about axis 41, even if the skier then keeps the boot on his or her foot. In fact, in the course of the opening movement of the rear spoiler 39, the support arms 43*d*, 43*e* of spring 43 slide along the rear and upper surface 45*a* of lever 45, and then, at a certain time, in the course of the rocking movement, they escape this surface while being placed at a distance from the lower and rear wall of shell base 38 and the arms 43*d* and 43*e* of spring 43 are there again biased by the disengagement ramp 50 during the rocking of rear spoiler 39 in the fully open position so that the latching spring 43 is then freed, which causes the automatic cutting off of the gas supply.

Figure 8:
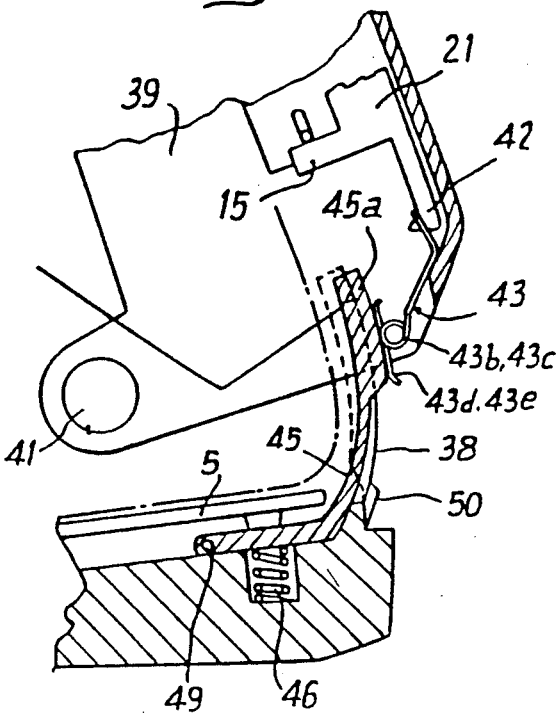
FIG. 8 is a vertical and longitudinal sectional view of an alternative embodiment of the lower part of the device incorporated into a downhill ski boot having a journalled rear spoiler.

FIG. 8 shows an alternative to the device which was just described, in which lever 45 is journalled about a generally horizontal and transverse axis 49 provided at the front end of its lower arm 45*b*. In this case, lever 45 pivots in one direction or another about axis 49, either under the action of the internal sole 5 or under that of return spring 46. The retention and disengagement the latching spring 43 with the hook of activation plate 21 is otherwise the same as with respect to the embodiment of FIG. 6.

Figure 10:
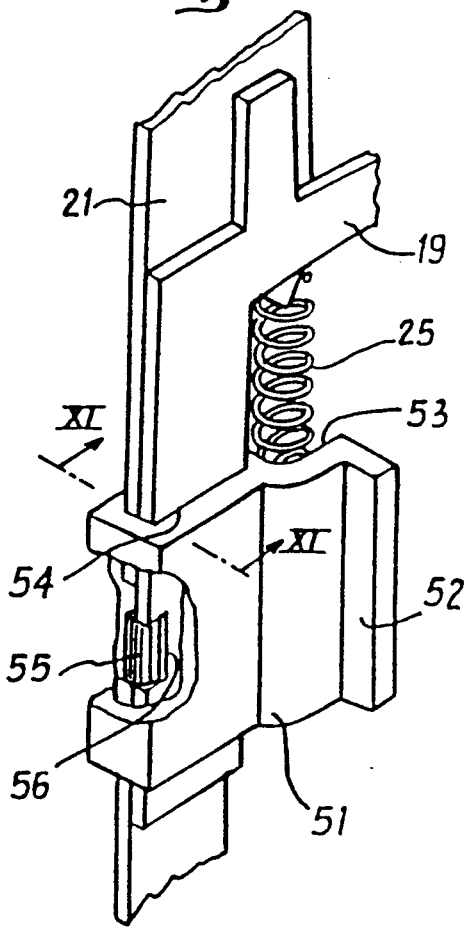
FIG. 10 is a partial perspective view of the gas supply control device shown in FIG. 9.
Figure 11:
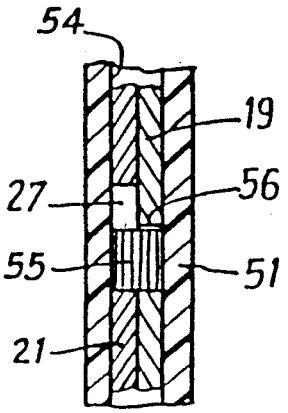
FIG. 11 is a partial vertical and longitudinal sectional view of the linkage means between the two plates of the control device shown in FIGS. 9 and 10.

FIGS. 9, 10, and 11 show an alternative embodiment of gas supply control device 16. In this embodiment, the two attached plates, namely, the manual control plate 19 and plate 21 for activation of valve 13, are lodged for vertically sliding in a common support 51 affixed to the rear wall of upper 12. This support 51 has two opposite lateral wings 52, extending vertically by which it rests against the rear wall of upper 12 and, between these two wings 52, a blind opening 53 closed at its lower part and opening into the upper surface of support 51. In this opening 53 the compression spring 25 is engaged which rests, at its lower end, in the bottom of housing 53 and which biases plate 21 upwardly. Support 51 has a hole 54 extending completely through, in its front part, the hole 54 having a horizontal cross-section with a generally rectangular shape corresponding to the superimposition of the rectangular cross-sections of two connected plates 19, 21 so that these two plates are closely guided for vertically sliding in support 51.

In the embodiment shown in FIGS. 9–11, the means permitting a relative vertical movement of the manual control plate 19 with respect to the activation plate 21 includes a cylindrical plug 55 lodged and immobilized in a cutout 56 of generally the same length, which is formed in the vertical front edge of the manual control plate 19. The plug 55 projects with respect to the surface of plate 19 which is in contact with the other plate 21 and it is engaged in a corresponding vertical slot 27 provided in plate 21. The length of the slot 27 is naturally selected greater than that of plug 55 so as to permit the relative sliding movement of plate 19 with respect to the other plate 21.

Figure 12:
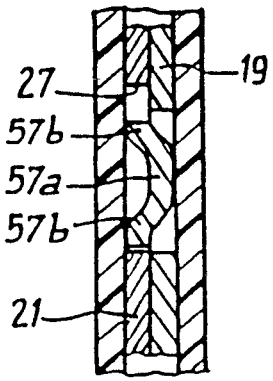
FIGS. 12 and 13 are partial vertical sectional views of alternative embodiments of the linkage means between the two plates of the gas supply control device.

In the alternative embodiment of the invention shown in FIG. 12, the element of plate 19 which projects in slot 27 of plate 21 is constituted by a tongue 57 which is cut in plate 19, while remaining adjoined thereto by one of its sides, and which is curved so as to extend in slot 27 of plate 21. In this embodiment, the projecting tongue 57 includes a central part **57*a* situated in the plane of plate 19 and two lateral wings 57*b* which are curved towards the exterior and which engage in the slot 27, so that the tongue 57** has substantially in cross-section the shape of an omega.

Figure 13:
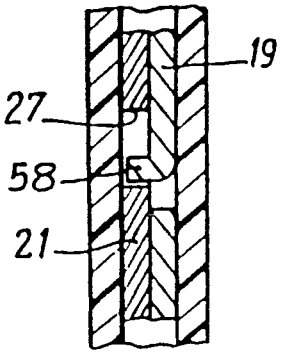

In the alternative embodiment of the invention shown in FIG. 13, the element projecting in slot 27 of plate 21 is constituted by a lug 58 which extends from plate 19 and which is curved to extend generally perpendicularly so as to project with respect to the plane of plate 19 and to be engaged in slot 27.

Although the invention has been described in terms of particular embodiments, comprising particular combinations of elements, materials, and functions, modifications can be made without departing from the scope of the invention defined by the following claims. For example, although the preceding description is directed to an alpine ski boot comprising, as an energy consuming device, a heating device, it is contemplated that the invention could apply likewise to any energy consuming device adapted, for example, to exert an automatic mechanical action.

Further, in the embodiment in which the heating assembly is of the electric type, in which case, a replaceable and/or rechargeable battery supply could be housed adjacent an upper of the boot which is connected to a resistance element or elements located proximate the internal sole of the boot. An electric switch could be provided in a location to be activated by the means for detecting the presence of the foot within the boot to disconnect the battery supply to the resistance element or elements. For example, consistent with any of the disclosed embodiments, the control knob 24 located for convenient access for the wearer of the boot on the rear of the boot, e.g., could be used to act on the aforementioned switch, in which case, the hooking of the activation plate in the lower position thereof would be effective to maintain the switch in the activated position for heating the boot. The activation and deactivation of the switch would be analogous to the opening and closing of the valve 13 by means of the lug 15 of activation plate 21 acting on the pin 14, as shown in FIG. 1.

We claim:

1. A ski boot having an energy source for supplying an energy consuming device and a device for controlling opening and closing of a supply element for supplying said energy consuming device connected between said energy source and said energy consuming device, wherein said boot comprises means for detecting the presence of a foot within said boot for allowing the opening of said element for supplying energy only when the foot is inserted into said boot and for automatically closing said supply element in response to the removal of the foot from said boot.

2. The boot according to claim 1, wherein said energy consuming device is a heating apparatus.

3. The boot according to claim 1, wherein said energy consuming device incorporated in said boot is an electric heating device, wherein said supply element comprises an electric switch connected between an electric energy source and at least one heat-resistant element, wherein said means for detecting the presence of the foot in said boot acts on said electric switch for producing heat by means of said at least one heat-resistant element.

4. The boot according to claim 1, wherein said energy consuming device incorporated in said boot is a heating device, wherein a said boot further comprises a reservoir for containing fuel, wherein said supply element comprises a valve for controlling a supply of said fuel from said reservoir to said heating device, and wherein said device for controlling said element comprises a device for controlling the opening and closing of said valve, wherein said means for detecting the presence of the foot in said boot acts on said device for controlling said valve.

5. The boot according to claim 4, wherein said means for detecting the presence of the foot in said boot is sensitive to pressure exerted by the foot on an internal sole of said boot, wherein said detection of the pressure is transmitted mechanically to said device for controlling the opening and closing of said valve.

6. A ski boot having an energy source for supplying an energy consuming device and a device for controlling opening and closing of a supply element for supplying said energy consuming device connected between said energy source and said energy consuming device, wherein said boot comprises means for detecting the presence of a foot within said boot for allowing the opening of said element for supplying energy only when the foot is inserted into said boot and for automatically closing said supply element in response to the removal of the foot from said boot, wherein said energy consuming device incorporated in said boot is a heating device, wherein said boot further comprises a reservoir for containing fuel, wherein said supply element comprises a valve for controlling a supply of said fuel from said reservoir to said heating device, and wherein said device for controlling said element comprises a device for controlling the opening and closing of said valve, wherein said means for detecting the presence of the foot in said boot acts on said device for controlling said valve, wherein said means for detecting the presence of the foot in said boot is sensitive to pressure exerted by the foot on an internal sole of said boot, wherein said detection of the pressure is transmitted mechanically to said device for controlling the opening and closing of said valve, wherein said boot comprises an upper having a rear wall and a control knob mounted for generally vertical movement outside the rear wall of said upper, wherein said device for controlling the opening and closing of said valve includes a device for activation of said valve for supplying said heating device with energy, said activation element, mounted for generally vertical movement within said upper of said boot, being moved by said control knob, within said upper of said boot, being moved by said control knob, said movable activation device supporting a latching means cooperating with an immobilization means supported by said upper and on which act said means for detecting the pressure of the foot so as to lock and unlock into a latching position said immobilization means, as a function of whether pressure is exerted on said internal sole of said boot, and, consequently, to latch and unlatch said activation element for opening and closing said valve, respectively.

7. The boot according to claim 6, wherein said energy supply control device includes two substantially vertical plates, adjacent to one another, generally contained in vertical and longitudinal planes, comprising a manual control plate and an activation plate, wherein said activation device comprises said activation plate for said supply valve, said activation plate having a greater height than said manual control plate, extending both above and beneath said manual control plate, wherein said activation plate supports, on a lower part, a lug for activating a control pin of said valve, said manual control plate having substantially the shape of a C open towards the rear and including a generally vertical member extended by a lower wing and an upper wing, said upper wing of said manual control plate extending outside the rear wall of said upper, and supporting, at an external end, said control knob, said activation plate being biased constantly upwardly by a spring which is coupled to said manual control plate by means permitting a relative vertical movement of said manual control plate with respect to said activation plate.

8. The boot according to claim 7, wherein said manual control plate includes, on an upper part, a lug extending upwardly and acting on a pawl which is journalled on the upper part of said activation plate about a generally horizontal and transverse axis, said pawl being in the form of a lever having two arms forming an acute angle and extending toward a rear wall of said upper, an end of said lower arm of said pawl being in contact with said lug and said upper arm of said pawl extending upwardly as far as said rear wall of said upper, said pawl being biased by a spring such that said upper arm is pushed constantly in the direction of said rear wall of said upper on which a slide is mounted for vertical movement, said slide forming a movable abutment for said pawl, said slide being connected, by a linkage rod assembly, to a lever lodged in the sole of said boot and activated by said internal sole.

9. The boot according to claim 8, wherein said lever is journalled, at a front end, about a generally horizontal and transverse axis, said lever being biased upwardly by a spring, said lever being hooked, at a rear end, to said linkage rod assembly and on said lever rests a rear end portion of said internal sole.

10. The boot according to claim 8, wherein said movable slide forms an abutment for said pawl having the shape of an inverted U, said slide including an upper horizontal and transverse member which is extended downwardly by two lateral and vertical wings connected to said linkage rod assembly, said upper member having a lower edge constituting a movable abutment for the end of said upper arm of said pawl.

11. The boot according to claim 9, wherein said movable slide forms an abutment for said pawl having the shape of an inverted U, said slide including an upper horizontal and transverse member which is extended downwardly by two lateral and vertical wings connected to said linkage rod assembly, said upper member having a lower edge constituting a movable abutment for the end of said upper arm of said pawl.

12. The boot according to claim 10, wherein said lower edge of said upper member of said slide is provided, in a central part thereof, with a cutout open downwardly and in which can engage a tooth solidly affixed with an internal surface of the rear wall of said upper, said tooth having substantially the shape of a right triangle whose upper side, constituting one of the sides of said triangle, serves as an abutment for said slide during downward movement of said slide and whose hypotenuse extends downwardly and forms a disengagement ramp for said pawl.

13. The boot according to claim 11, wherein said lower edge of said upper member of said slide is provided, in a central part thereof, with a cutout open downwardly and in which can engage a tooth solidly affixed with an internal surface of the rear wall of said upper, said tooth having substantially the shape of a right triangle whose upper side, constituting one of the sides of said triangle, serves as an abutment for said slide during downward movement of said slide and whose hypotenuse extends downwardly and forms a disengagement ramp for said pawl.

14. The boot according to claim 6, of the type comprising a shell base on which is journalled a rear spoiler, about a generally horizontal and transverse axis, wherein said activation plate supports, at a lower part, a hook for engagement with an extreme upper part of a latching spring supported by a lower part of said rear spoiler.

15. The boot according to claim 14, wherein said latching spring includes a central upper part in the shape of a loop, open downwardly, having two lateral arms extending, at lower ends thereof, by helical coaxial windings surrounding a generally horizontal and transverse axis supported by said lower and rear part of said rear spoiler, said helical coaxial windings having extending generally coplanar support arms forming an acute angle with the upper loop and applied against the upper part of a lever substantially in the shape of an L which includes a lower wing substantially horizontal, extending frontwardly, under a rear part of said internal sole, a return spring being lodged beneath said lower horizontal wing of said lever to continuously push said wing upwardly, and an external projection, forming a disengagement ramp for said spring, which is provided on the lower part of a rear wall of the shell base to act on said support arms of said spring, at the end of the opening movement of said rear spoiler, and to enable said spring to escape from said hook of said activation plate.

16. The boot according to claim 15, wherein each of said support arms of said spring has substantially the shape of a U open downwardly, whose arms extend both above and beneath said winding axis.

17. The boot according to claim 15, wherein said upper part of said lever has slots which are inclined from top to bottom and from front to rear, within which horizontal and transverse projections extend which are solidly affixed with said shell base, to control movement of said lever.

18. The boot according to claim 16, wherein said upper part of said lever has slots which are inclined from top to bottom and from front to rear, within which horizontal and transverse projections extend which are solidly affixed with said shell base, to control movement of said lever.

19. The boot according to claim 15, wherein said lever is journalled about a generally horizontal and transverse axis provided at the front end of said lower arm of said lever, said lever pivotal in one direction or another about said lever axis, either under the action of said internal sole or under the action of said return spring.

20. The boot according to claim 16, wherein said lever is journalled about a generally horizontal and transverse axis provided at the front end of said lower arm of said lever, said lever pivotal in one direction or another about said lever axis, either under the action of said internal sole or under the action of said return spring.

21. An item of wearing apparel which includes means for receiving an extremity, said item comprising:

(a) a gaseous energy source;

(b) an energy consuming device comprising a heating device; and (c) means for controlling a supply of energy from said energy source to said energy consuming device comprising means for preventing said supply of energy from said energy source to said energy consuming device in response to removal of said extremity from said means for receiving an extremity.

22. The item of wearing apparel of claim 21, wherein said energy source is an interchangeable gas fuel cartridge.

23. The item of wearing apparel of claim 21, wherein said item of wearing apparel is a boot for receiving a foot.

24. The item of wearing apparel of claim 23, wherein said boot comprises an upper and wherein said energy source and said means for controlling the supply of energy from said energy source to said energy consuming device is supported by said upper.

25. An item of wearing apparel which includes means for receiving an extremity, said item comprising:

(a) an energy source;

(b) an energy consuming device; and (c) means for controlling a supply of energy from said energy source to said energy consuming device comprising means for preventing said supply of energy from said energy source to said energy consuming device in response to removal of said extremity from said means for receiving an extremity, wherein said means for preventing said supply of energy from said energy source to said energy consuming device comprises means for detecting the presence of an extremity within said means for receiving said extremity, wherein said supply of energy is prevented upon failure of said detecting means to detect the presence of an extremity.

26. The item of wearing apparel of claim 25, wherein said means for controlling the supply of energy from said energy source to said energy consuming device comprises a manually actuated energy supply switch movable at least between an ON position, in which said supply of energy is permitted between said energy source and said energy consuming device, and an OFF position, in which said supply of energy is prevented from said energy source, wherein said means for controlling the supply of energy from said energy source to said energy consuming device comprises means for linking said means for detecting the presence of an extremity within said means for receiving an extremity to said energy switch, wherein upon said failure of said detecting means to detect the presence of an extremity, said energy switch is permitted to move to said OFF position.

27. The item of wearing apparel of claim 26, further comprising means for biasing said energy switch toward said OFF position and means for maintaining said energy switch in said ON position against a force of said means for biasing in response to said detecting means detecting the presence of an extremity.

28. The item of wearing apparel of claim 26, wherein said item of wearing apparel is a boot and wherein said energy consuming device is a heating apparatus.

29. The item of wearing apparel of claim 28, wherein said means for detecting the presence of an extremity within said means for receiving an extremity comprises a member located proximate an internal sole of said boot which is moved by means of pressure exerted thereon by said extremity.

30. The boot according to claim 4, wherein said fuel supplied to said heating device is liquid.

31. The boot according to claim 4, wherein said fuel applied to said heating device is gaseous.

* * * * *